US006355607B1

(12) United States Patent
Rahman et al.

(10) Patent No.: US 6,355,607 B1
(45) Date of Patent: Mar. 12, 2002

(54) TABLETS, AND PROCESS FOR MAKING TABLETS

(75) Inventors: Sonia Rahman, Strombeek-Bever; Paul Irma Albertus Van Dijk, Putte, both of (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/424,557

(22) PCT Filed: May 18, 1998

(86) PCT No.: PCT/IB98/00755

§ 371 Date: Nov. 24, 1999

§ 102(e) Date: Nov. 24, 1999

(87) PCT Pub. No.: WO98/54284

PCT Pub. Date: Dec. 3, 1998

(30) Foreign Application Priority Data

May 27, 1997 (EP) ..... 97870074

(51) Int. Cl.[7] ..... C11D 17/00; C11D 11/00

(52) U.S. Cl. ..... 510/446; 510/224; 510/294; 510/298; 510/361; 510/441; 510/509

(58) Field of Search ..... 510/446, 224, 510/294, 298, 361, 509, 441

(56) References Cited

U.S. PATENT DOCUMENTS

| | | | | | |
|---|---|---|---|---|---|
| 3,775,348 | A | | 11/1973 | Jakobi et al. | 252/524 |
| 4,219,435 | A | * | 8/1980 | Biard et al. | 510/439 |
| 4,552,679 | A | * | 11/1985 | Schobel et al. | 510/117 |
| 4,828,749 | A | * | 5/1989 | Kruse et al. | 510/224 |
| 5,718,729 | A | | 2/1998 | Harris | 8/137 |
| 5,866,531 | A | * | 2/1999 | Assmann et al. | 510/446 |
| 5,916,866 | A | * | 6/1999 | Davies et al. | 510/441 |
| 6,211,129 | B1 | * | 4/2001 | Gladfelter et al. | 510/294 |

FOREIGN PATENT DOCUMENTS

| | | | | |
|---|---|---|---|---|
| DE | 2442712 | * | 3/1976 | |
| EP | 0 093 784 A1 | | 11/1983 | C11D/7/42 |
| EP | 0093784 | * | 11/1983 | |
| EP | 0 269 982 A2 | | 6/1988 | C11D/3/12 |
| EP | 0 504 091 A1 | | 9/1992 | C11D/3/00 |
| EP | 0 838 519 A1 | | 4/1998 | C11D/17/00 |
| FR | 2152810 | * | 4/1973 | |
| GB | 1 507 356 | | 4/1978 | C11D/3/32 |
| GB | 2 303 635 A | | 2/1997 | C11D/3/36 |
| JP | 49041548 | * | 4/1974 | |
| ZA | 9106767 | * | 9/1992 | |

* cited by examiner

*Primary Examiner*—Lorna M. Douyon
(74) *Attorney, Agent, or Firm*—Marianne Dressman; Kim William Zerby; Steven W. Miller

(57) ABSTRACT

A tablet comprising a combination of a means for providing effervescency upon contact with water, as well as a soluble salt selected from the group consisting of acetate, urea, and mixtures thereof is disclosed. The means for providing effervescence upon contact with water preferably comprises citric acid and a carbonate salt, such as a bicarbonate salt. Also disclosed is a process for making tablets according to the present invention.

7 Claims, No Drawings

TABLETS, AND PROCESS FOR MAKING TABLETS

The present invention relates to the field of tablets, especially those adapted for use with laundry, i.e. washing clothes etc., and automatic dishwashing.

Some tablets are designed to dissolve or disintegrate in a liquid, for example water, before use in order to provide a solution or suspension of active ingredients. When such tablets need to be dissolved or disintegrated, problems often arise due to the rate of dissolution and disintegration of the tablets. These problems are particularly severe in the field of detergent tablets where it is desirable to rapidly deliver active ingredients, especially surface active agents (surfactants). Furthermore these problems are particular severe when detergent tablets are use for hand-washing, as opposed to machine washing, because very little agitation is provided by hand.

"Detergents Manufacture" by Marshall Sittig, published by Noyes Data Corp. 1976, says on page 340 that "the production of [detergent] tablets requires very special measures as regards selecting the components of the tablet and working up these components into the final detergent tablet. Consequently the production of detergent tablets is a complex matter. It involves even more than the mere selection of the components or the compression of a particular detergent composition into a tablet: the tablet must be capable of withstanding shocks of packing, handling and distribution without crumbling. In other words the tablet must be strong. Besides the tablet must have a satisfactory rate of disintegration when put in water. The tablets known so far have generally shown too long a disintegration time, in favour of their strength, or they have had a very low strength, in favor of their disintegration time."

One of the approaches known in the prior art to try to address this problem is the use of acetate salt to improve the dissolution rate of detergents compressed in the form of tablets. For instance:

EP-A-0 002 293, published on Jun. 13, 1979, discloses detergent tablets containing hydrated salt. The preferred hydrate salt is a mixture of sodium acetate trihydrate and sodium metaborate tetrahydrate.

Another approach known in the prior art to try to address this problem is to use effervescent aids to improve tablet disintegration:

CA-A-2 040 307, discloses laundry detergent tablets comprising anionic surfactants mixed with sodium carbonate and citric acid.

The object of the present invention is to provide tablets which have a rapid rate of disintegration and dissolution, and which are at the same time sufficiently strong to withstand shocks of packing, handling and distribution without crumbling. A particular object of the present invention is to is to provide tablets which rapidly deliver active ingredients, especially surface active agents into solution, especially during a laundry process with little mechanical agitation, such as handwash. It is a further object of the invention that tablets, when used in a domestic, front-loading washing machine,will leave little or no visible residue in the window of the machine during the wash cycle.

SUMMARY OF THE INVENTION

The object of the invention is achieved by providing a tablet comprising a combination of a means for providing effervescency upon contact with water, as well as a soluble salt selected from the group consisting of acetate, urea, and mixtures thereof. The means for providing effervescency upon contact with water preferably comprises citric acid and a carbonate salt, such as a bicarbonate salt.

Preferably the acetate or urea is present at a level of from 1% to 50% by weight of the tablet. Preferably also the tablet further comprises at least 5% by weight of a surface active agent.

DETAILED DESCRIPTION OF THE INVENTION

Any means for providing effervescency upon contact with water may be used in the present invention. Some suitable examples are described by R. Mohrie in"Pharmaceutical dosage forms: tablets volume 1, Ed H. A. Lieberman et al", published in 1989.

The most common means for providing effervescency is an acidification component and a carbonate salt. Upon contact with water the two components react to yield carbon dioxide gas. Preferred acidification components include inorganic and organic acids including for example carboxylate acids such as citric and succinic acids, polycarboxylate acids such as polyacrylic acid and also acetic acid, boric acid, malonic acid, adipic acid, fumaric acid, lactic acid, glycolic acid, tartaric acid, tartronic acid, ascorbic acid, phthalic acid, stearic acid, gluconic acid, malic acid, maleic acid, their derivatives (e.g. acid anhydrides such as succinic anhydride, citric anhydride), ethane, 1-hydroxy, 1,1 diphosphonic acid (HEDP) and any mixtures thereof. A highly preferred acidification acid is citric acid which has the advantage of providing builder capacity to the wash solution, leading to better soil removal. Other suitable acid sources are acid salts such as sodium dihydrogen phosphate (monosodium phosphate), disodium dihydrogen pyrophosphate (sodium acid pyrophosphate), acid citrate salts (e.g. sodium dihydrogen citrate and disodium hydrogen citrate), sodium acid sulfite (sodium bisulfite) and mixtures thereof. Bicarbonates, particularly sodium bicarbonate are also useful acidification agents in cases where the carbonate salt used is one which is more alkaline than sodium bicarbonate.

The term carbonate salt herein is used to mean any salt which is capable of releasing carbon dioxide when reacted with an acid. Preferred carbonate salts include sodium bicarbonate, sodium carbonate, potassium bicarbonate and potassium carbonate, sodium sesquicarbonate, sodium glycine carbonate, L-lysine carbonate, arginine carbonate, amorphous calcium carbonate and mixtures thereof.

Other suitable means for providing effervescency are anhydrous sodium perborate or effervescent perborate (this latter is sodium perborate monohydrate or tetrahydrate heated to drive their water off).

Soluble salts useful in the present invention include salts such as sodium acetate, ammonium acetate, calcium acetate, potassium acetate, rubidium acetate, urea and mixtures thereof.

The present invention provides a tablet which easily and rapidly disintegrates upon contact with water, even with a small amount of agitation, such as occurs in hand-wash. Once disintegrated the tablet fragments easily and rapidly dissolve in the water. Without wishing to be bound by theory the mechanism behind the synergistic effect between the acetate and the means for providing effervescency could be as follows:

(i) acetate salts are highly water soluble material which dissolve rapidly when brought into contact with water. Its rapid dissolution leads to a tablet with a porous structure which is easily disintegrated;

(ii) the disintegrated tablet exposes the means for providing effervescency to the water, and the gas generated acts to disrupt the normal tablet structure, allowing contact of more tablet surfaces with wash water, which promotes dissolving.

The combination of these two different modes of tablet disruption induces a higher level of disintegration than that which could be expected when either of these mechanisms is used alone.

Optionally the tablets of the present invention may also be provided with a coating. The coating should allow the tablets to be handled in normal use with breaking. Tablets which might otherwise be too fragile may be provided with a coating for this purpose.

Particularly preferred coatings materials are fatty acids, adipic acid and C8–C13 dicarboxylic acids, fatty alcohols, diols, esters and ethers. Preferred fatty acids are those having a carbon chain length of from C12 to C22 and most preferably from C18 to C22. Preferred dicarboxylic acids are adipic acid (C6), suberic acid (C8), azelaic acid (C9), sebacic acid (C10), undecanedioic acid (C11), dodecanedioic acid (C12) and tridecanedioic acid (C13). Preferred fatty alcohols are those having a carbon chain length of from C12 to C22 and most preferably from C14 to C18. Preferred diols are 1,2-octadecanediol and 1,2-hexadecanediol. Preferred esters are tristearin, tripalmitin, methylbehenate, ethylstearate. Preferred ethers are diethyleneglycol mono hexadecylether, diethyleneglycol mono octadecylether, diethyleneglycol mono tetradecylether, phenylether, ethyl naphtyl ether, 2 methoxynaphtalene, beta naphtyl methyl ether and glycerol monooctadecylether. Other preferred coating materials include dimethyl 2,2 propanol, 2 hexadecanol, 2 octadecanone, 2 hexadecanone, 2, 15 hexadecanedione and 2 hydroxybenzyl alcohol.

The optional coating can be applied in a number of ways. Two preferred coating methods are a) coating with a molten material and b) coating with a solution of the material.

In a), the coating material is applied at a temperature above its melting point, and solidifies on the tablet. In b), the coating is applied as a solution, the solvent being dried to leave a coherent coating. The optional coating material is preferably a substantially insoluble material which can be applied to the tablet by, for example, spraying or dipping. Normally when the molten material is sprayed on to the tablet, it will rapidly solidify to form a coherent coating. When tablets are dipped into the molten material and then removed, the rapid cooling again causes rapid solidification of the coating material. Clearly substantially insoluble materials having a melting point below 40° C. are not sufficiently solid at ambient temperatures and it has been found that materials having a melting point above about 180° C. are not practicable to use. Preferably, the materials melt in the range from 60° C. to 160° C., more preferably from 70° C. to 120° C.

By "melting point" is meant the temperature at which the material when heated slowly in, for example, a capillary tube becomes a clear liquid.

A coating of any desired thickness can be applied according to the present invention. For most purposes, the coating forms from 1% to 10%, preferably from 1.5% to 5%, of the tablet weight.

The tablet coatings, when present, are very hard and provide extra strength to the tablet.

A preferred processes for making tablets according to the present invention comprise the step of forming a core by compressing a particulate material, the particulate material comprising surfactant and detergent builder, and further comprising an acetate component and means for providing effervescency upon contact with water. The particulate material used for making the tablet of this invention can be made by any particulation or granulation process. An example of such a process is spray drying (in a co-current or counter current spray drying tower) which typically gives low bulk densities 600 g/l or lower. Particulate materials of higher density can be prepared by granulation and densification in a high shear batch mixer/granulator or by a continuous granulation and densification process (e.g. using Lodige® CB and/or Lodige® KM mixers). Other suitable processes include fluid bed processes, compaction processes (e.g. roll compaction), extrusion, as well as any particulate material made by any chemical process like flocculation, crystallisation sentering, etc. Individual particles can also be any other particle, granule, sphere or grain.

The particulate materials may be mixed together by any conventional means. Batch is suitable in, for example, a concrete mixer, Nauta mixer, ribbon mixer or any other. Alternatively the mixing process may be carried out continuously by metering each component by weight on to a moving belt, and blending them in one or more drum(s) or mixer(s). A liquid spray-on to the mix of particulate materials (e.g. non-ionic surfactants) may be carried out. Other liquid ingredients may also be sprayed on to the mix of particulate materials either separately or premixed. Optionally, liquid ingredients may be sprayed onto an inert component in the formulation prior to mixing of the ingredients. For example perfume and slurries of optical brighteners may be sprayed. A finely divided flow aid (dusting agent such as zeolites, carbonates, silicas) can be added to the particulate materials after spraying the non-ionic, preferably towards the end of the process, to make the mix less sticky.

The tablets may be manufactured by using any compacting process, such as tabletting, briquetting, or extrusion, preferably tabletting. Suitable equipment includes a standard single stroke or a rotary press (such as Courtoy®, Korch®, Manesty®, or Bonals®). The tablets prepared according to this invention preferably have a diameter of between 10 mm and 70 mm, and a weight between 2 and 150 g. The compaction pressure used for preparing these tablets need not exceed 20000 $kN/m^2$, preferably not exceed 5000 $kN/m^2$, and most preferably not exceed 1000 $kN/m^2$.

EXAMPLES

Example 1 i) A detergent base powder of composition A was prepared as follows: all the particulate materials of base composition A, except for the dried zeolite were mixed together in a mixing drum to form a homogeneous particulate mixture. During this mixing the spray-ons were carried out. After the spray-ons the dusting was carried out with the dried zeolite.

ii) 80 parts of base powder of composition A was mixed in a mixing drum with 15 parts of sodium acetate and 5 parts of an effervescent mix comprising 54.5% sodium bicarbonate and 45.5% citric acid.

iii) Tablets were then made the following way. 45 g of the mixture was introduced into a mould of circular shape with a diameter of 4.5 cm and compressed to give tablets of 2.3 cm height and a density of 1.1 g/cc. The tensile strength (or diametrical fracture stress) of the tablet was 10.2 kPa iv) The rate of disintegration of the detergent tablet was assessed by means of the "basket test": the tablet is weighed, placed in a perforated 10 cm*7 cm rectangular metallic basket with a mesh size of 1 cm*1 cm. The basket is laid at the bottom of a beaker of demineralised water at 20° C. The residue left in the basket after a residence time of 1 min in the pool of stagnant water was determined by weighing. The level of tablet disintegration was determined as follows:

$$\%\,\text{disintegration} = \frac{\text{original tablet weight} - \text{residue weight}}{\text{original tablet weight}}$$

TABLE 1

Detergent base powder composition (Compn. A)

| | % by weight |
|---|---|
| Anionic agglomerates | 26.80 |
| Nonionic agglomerate | 5.93 |
| Bleach activator agglomerates | 6.10 |
| Zinc Phthalocyanine sulphonate encapsulate | 0.03 |
| Suds suppressor | 3.46 |
| Dried Zeolite | 6.75 |
| Layered Silicate | 14.67 |
| Dye transfer inhibitor agglomerate | 0.14 |
| Perfume encapsulates | 0.25 |
| Noionic paste spray-on | 5.82 |
| Fluorescer | 0.28 |
| Sodium carbonate | 5.02 |
| Sodium percarbonate | 21.20 |
| Sodium HEDP | 0.85 |
| Soil release polymer | 0.19 |
| Perfume | 0.35 |
| Protease | 0.92 |
| Cellulase | 0.27 |
| Lipase | 0.23 |
| Amylase | 0.75 |

Anionic agglomerates comprise 38% anionic surfactant, 22% zeolite and 40% carbonate.

Nonionic agglomerates comprise 26% nonionic surfactant, 48% zeolite and 26% carbonate.

Bleach activator agglomerates comprise 81% TAED, 17% acrylic/maleic copolymer (acid form) and 2% water.

Zinc phthalocyanine sulphonate encapsulates are 10% active. Suds suppressor comprises 11.5% silicone oil (ex. Dow Corning) and 88.5 starch.

Layered silicate comprises 78% SKS-6 (ex Hoechst) and 22% citric acid.

Dye transfer inhibitor agglomerates comprise 21% PVNO/PVPVI, 61% zeolite and 18% carbonate.

Perfume encapsulates comprise 50% perfume and 50% starch.

Nonionic paste spray-on comprises 67% C12–C15 AE5 (alcohol with an average of 5 ethoxy groups per molecule), 24% N-methyl glucose amide and 9% water.

Example 2–8

The effervescent means and acetate levels were modified according to the levels indicated in table 2.

TABLE 2

Tablet Composition

| | Ex. 1 | Ex. 2 | Ex. 3 | Ex. 4 | Ex. 5 | Comparative Ex. 6 | Comparative Ex. 7 |
|---|---|---|---|---|---|---|---|
| Base powder of compn. A | 80 | 80 | 90 | 90 | 90 | 80 | 80 |
| Citric acid | 2.28 | 4.55 | 2.28 | 4 | 1 | 9.10 | 0.00 |
| Sodium bicarbonate | 2.73 | 5.45 | 2.73 | 1 | 4 | 10.90 | 0.00 |
| Sodium acetate | 15 | 10 | 5 | 5 | 5 | 0 | 20 |

TABLE 3

Improved tablet disintegration through the simultaneous use of effervescent aid and acetate system.

| | Ex. 1 | Ex. 2 | Comparative Ex. 6 | Comparative Ex. 7 |
|---|---|---|---|---|
| % Disintegration after 1 min | 35.8 | 35.0 | 30.6 | 13 |

Example 8 i) HEDP in acid form as a means for providing effervescency was sprayed as a liquid onto granular sodium sulfate as a carrier. The HEDP particle was then admixed into a granular composition as follows:

| Ingredient | Wt. % |
|---|---|
| Sodium tripolyphosphate | 33 |
| HEDP Particle | 17 |
| Sodium Carbonate | 15 |
| Amylase | 0.5 |
| Protease | 0.75 |
| Nonionic Surfactant | 2 |
| Silicate | 10 |
| Perborate | 10 |
| Misc., Perfumes, Water | to 100 |

ii) The admixed composition is then tabletted via conventional means.

Example 9 i) HEDP in acid form as a means for providing effervescency was sprayed as a liquid onto granular sodium sulfate as a carrier. The HEDP particle was then admixed into a granular composition as follows:

| Ingredient | Wt. % |
|---|---|
| Sodium tripolyphosphate | 33 |
| HEDP Particle | 17 |
| Sodium Carbonate | 15 |
| Sodium Acetate | 2 |
| Amylase | 0.5 |
| Protease | 0.75 |
| Nonionic Surfactant | 2 |
| Silicate | 10 |
| Perborate | 10 |
| Misc., Perfumes, Water | to 100 |

ii) The admixed composition is then tabletted via conventional means.

What is claimed is:

1. A detergent tablet comprising a means for providing effervescency upon contact with water which comprises an acid source and a carbonate salt, characterized in that it further comprises a soluble salt of acetate and at least 5% by weight of a surface active agent.

2. Tablet according to claim 1 wherein the means for providing effervescency upon contact with water comprises citric acid and a carbonate salt.

3. Tablet according to claim 2 wherein the means for providing effervescency upon contact with water comprises citric acid and a bicarbonate salt.

4. Tablet according to claim 3 wherein the soluble salt is a salt selected from the group consisting of sodium acetate, ammonium acetate, calcium acetate, potassium acetate, rubidium acetate and mixtures thereof, and is present at a level of from 1% to 50% by weight of the tablet.

5. A process for making a tablet comprising the step of forming a core by compressing a particulate material, the particulate material comprising at least 5% by weight of a surfactant and detergent builder; characterized in that the particulate material further comprises a means for providing effervescency upon contact with water which comprises an acid source and a carbonate salt, and a soluble salt of acetate.

6. A process according to claim 5 further comprising the steps of (b) applying a coating material to the core, the coating material being in the form of a melt;

(c) allowing the molten coating material to solidify.

7. A process according to claim 5 further comprising the steps of:

(b) applying a coating material to the core, the coating material being dissolved in a solvent;

(c) allowing the solvent to evaporate.

* * * * *